US005638684A

United States Patent [19]

Siegel et al.

[11] Patent Number: 5,638,684

[45] Date of Patent: Jun. 17, 1997

[54] STIRLING ENGINE WITH INJECTION OF HEAT TRANSFER MEDIUM

[75] Inventors: André Siegel, Dorsten; Kai Schiefelbein, Oberhausen, both of Germany

[73] Assignee: Bayer Aktiengesellschaft, Leverkusen, Germany

[21] Appl. No.: 585,006

[22] Filed: Jan. 11, 1996

[30] Foreign Application Priority Data

Jan. 16, 1995 [DE] Germany ..... 195 01 035.3

[51] Int. Cl.[6] ..... F25B 9/14

[52] U.S. Cl. ..... 62/6

[58] Field of Search ..... 62/6, 114; 60/670, 60/688

[56] References Cited

U.S. PATENT DOCUMENTS

| | | | |
|---|---|---|---|
| 3,858,802 | 1/1975 | Stobart | 237/12.1 |
| 3,996,745 | 12/1976 | Davoud et al. . | |
| 5,142,872 | 9/1992 | Tipton | 62/6 |
| 5,522,222 | 6/1996 | Kwon | 62/6 |

FOREIGN PATENT DOCUMENTS

| | | | |
|---|---|---|---|
| 404093559 | 3/1992 | Japan | 62/6 |
| 404356666 | 12/1992 | Japan | 62/6 |
| 9412785 | 6/1994 | WIPO . | |

*Primary Examiner*—William Doerrler

*Attorney, Agent, or Firm*—Sprung Horn Kramer & Woods

[57] ABSTRACT

This invention relates to a Stirling engine as a refrigerating machine or heat pump having improved heat transfer to the working gas or improved heat transfer from the working gas of the Stirling engine to a cooling medium with simultaneous reduction of the dead space in the engine. The Stirling engine operates with injection or atomisation of a heat transfer fluid into the working spaces of the engine, due to which the heat transfer between the heat transfer medium and the working gas is improved.

6 Claims, 4 Drawing Sheets

STIRLING ENGINE WITH INJECTION OF HEAT TRANSFER MEDIUM

Figure 1:
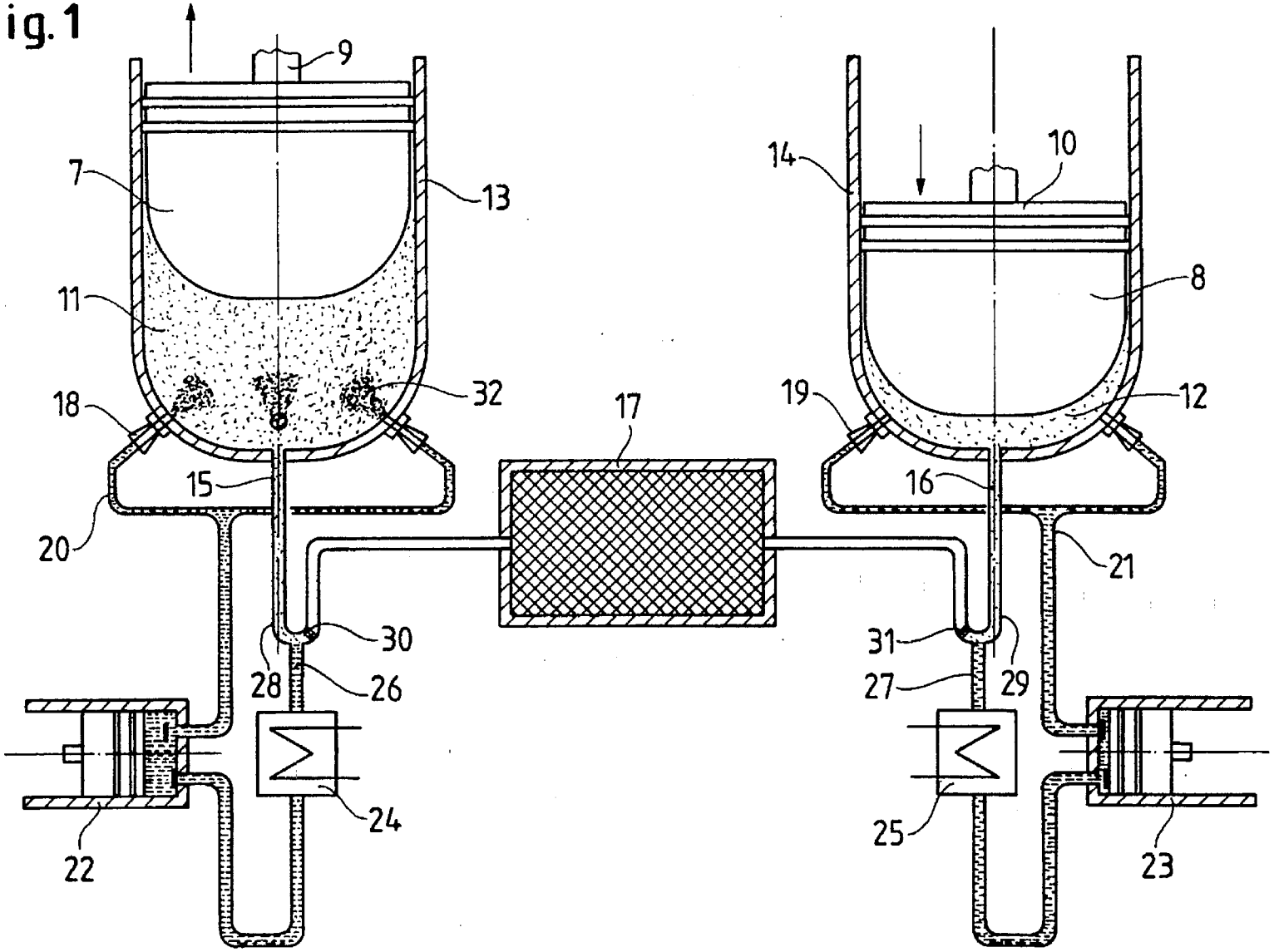

This invention relates to a Stirling engine as a refrigerating machine or heat pump having improved heat transfer to the working gas or improved heat transfer from the working gas of the Stirling engine to a cooling medium with simultaneous reduction of the dead space in the engine. This is achieved by the injection of a heat transfer medium into the working spaces of the Stirling engine. The heat transfer medium is atomised during injection. The increase in heat transfer between the heat transfer medium and the gas is essentially due to the increase in the heat transfer surface.

Stirling refrigerating machines for producing cryotechnic temperatures (below about −50° C.) are known, and are described, for example, in G. Walker, Stirling Engines, Clarendon Press, Oxford, 1980, C. M. Hargreaves, The Philips Stirling Engine, Elsevier, Amsterdam, 1991; in A. Binneberg, O. Hempel, A. Tzscheutschler, 15W/80K-Integral-Stirling-Källtemaschine aus Ki Luft- und Kältetechnik [15W/80K *Integral Stirling Refrigerating Machine from Ki Ventilation and Refrigeration Engineering*] 5/1994, and in J. W. L. Köhler, C. O. Jonkers, Grundlagen der Gaskältemaschine [*Principles of the Gas Refrigerating Machine*], Philips Technische Rundschau, 15th Volume Year, No. 11, May 1954.

Theoretical considerations on the use of Stirling refrigerating machines in refrigeration and air-conditioning technology have also been made by AEG Aktiengesellschaft, Heilbronn (see also: H. Laschütza, M. Bareiss, "Is the Gas Stirling refrigerating machine suitable for use in refrigeration and air-conditioning technology?", contribution to the DKV [*German Refrigeration Association*] annual conference held on 17.–19.11.93). According to these considerations, ribbed tubes through which the working gas flows are provided in a Stirling engine for heat transfer to the working gas. A Stirling refrigerating machine having a heat transfer medium circuit for cooling the passenger compartment of automobiles is described in U.S. Pat. No. 5,094,083. The heat transfer medium is cooled in a copper block provided with bores on the cold top of the Stirling refrigerating machine, and provides cooling to the interior of the vehicle via a conventional heat exchanger.

The Toshiba Corporation, in collaboration with the Hashirimizu National Academy, has developed two Stirling refrigerating machines for the production of cooling at temperatures of 173 K and 258 K, respectively (see also: H. Kagawa, K Araoka, T. Otaka, "Design and Development of a Miniature Stirling Machine", Proceedings of the Intersociety Energy Conversion Conference, 1991). Ribbed tubes and ribbed coaxial tubes through which the working gas of the Stirling refrigerating machines flow are used as heat exchangers in these machines.

Heat transfer in other Stirling engines which have become known is effected by the conduction of heat through the wall of the expansion space of the Stirling refrigerating machine.

In refrigeration and air-conditioning technology, cooling is usually produced by means of cold evaporation refrigerating machines, which are expressly described in the publication by Jungnickel, Agsten and Kraus "Grundlagen der Kältetechnik" ["*Principles of Refrigeration Technology*"], Verlag C. F. Müller, Karlsruhe, 1981, for example. Fundamentally the same technology is also utilised for heat pump applications. Chlorofluorocarbons (CFCs or HCFCs) are predominantly used as the working medium in cold evaporation machines. The use of CFCs as coolants is already prohibited in Federal Republic of Germany in accordance with the Prohibition Order of 06.05.91, or their prohibition is at least imminent (situation as of 1994), due to the destructive effect of these compounds on the ozone layer. The fluorocarbons (FCs and HFCs) which are possible replacements must also be considered as environmentally harmful due to their contribution to the greenhouse effect in the atmosphere.

Compared with refrigerating machines or heat pumps which operate based on the aforementioned cold evaporation process, the Stirling refrigerating machines which have been produced or proposed hitherto for use in near-ambient temperature ranges have a lower volume output and a lower figure of merit. Moreover, the spatial proximity of the cold and warm ends of the machines makes their practical use in different applications considerably more difficult.

The underlying object of the present invention is to develop a refrigerating machine or heat pump having a working gas which is environmentally or toxicologically harmless, which can compete with the known cold evaporation refrigerating machines of cold evaporation heat pumps as regards volume output and figure of merit.

This object is achieved according to the invention, in a modified Stirling refrigerating machine or heat pump, in that a heat transfer fluid is injected into at least one working space of the Stirling refrigerating machine or heat pump, to which heat transfer fluid the heat produced during the approximately isothermal compression of the working gas is transferred, or from which the heat absorbed during the approximately isothermal expansion of the working gas is removed. Injection of the heat transfer fluid is effected during expansion or compression in each case. After the absorption or release of heat, the heat transfer fluid is pumped out of the Stirling refrigerating machine via a collector downstream of a liquid separation device, and is fed back to the injection pump again via a heat exchanger where it gives up the absorbed heat or absorbs heat from the surroundings. Pre-cooling or pre-heating of the heat transfer fluid may be effected before injection, by heat exchange with the working gas via the cylinder walls of the Stirling engine.

This invention relates to a Stifling engine, preferably as a Stirling refrigerating machine or heat pump, consisting of at least one working space, a cold space, a diaphragm or a piston with an attached transmission, optionally a regenerator between the working space and the cold space, and optionally overflow lines which connect the working space, the cold space and optionally the regenerator to each other, characterised in that injection of heat transfer medium is provided in at least one of the spaces for heat transfer between the respective working gas of the spaces and a heat transfer fluid which is optionally atomised on injection, that at least one separator for the heat transfer fluid is provided on at least one of the spaces or is connected into the overflow line which is optionally present, and that the heat transfer fluid separated from the working gas is fed in circulation from the separator to the injection of heat transfer medium again via a heat exchanger and a pump.

Heat transfer fluids having the following properties are preferably used:

In particular, the heat transfer fluid should have a vapour pressure which is as low as possible even at the upper process temperature, in order to keep contamination of the working gas by the heat transfer medium as low as possible.

In particular, the heat transfer fluid should have a melting point which is as low as possible, since this determines the lowest possible temperature for producing cooling.

In particular, the heat transfer fluid should have a low viscosity, even at low temperatures, since the nozzle admission pressure which is necessary for atomising the heat transfer fluid depends on the viscosity to the power of about 0.5.

In particular, it should have a low surface tension, even at low temperatures, since the nozzle admission pressure which is necessary for atomising the heat transfer fluid depends on the surface tension of the fluid to the power of about 0.5.

In particular, the heat transfer fluid should also have a good thermal conductivity, since this reduces the time interval required for heating or cooling the liquid droplets.

In particular, the heat transfer fluid should have a high specific heat capacity, since the volume of liquid to be injected increases linearly as the heat capacity of the heat transfer medium decreases.

In addition, the heat transfer fluid should be as chemically inert as possible and optionally stable to thermal decomposition up to about 150° C.

The aforementioned special requirements for a suitable heat transfer fluid are fulfilled by silicone oils in particular.

Of the working gases for the Stirling process, those which are particularly suitable include the gases helium, hydrogen, nitrogen, argon, neon and air, as well as mixtures of the said gases.

In a preferred embodiment the Stifling engine is constructed as an engine with two working pistons and a suspended arrangement of the cylinders. A piston or diaphragm pump for each of the two working spaces of the Stifling engine is preferably employed for the injection of the heat transfer fluid. Under some circumstances these pumps are mechanically coupled to the shaft of the Stirling engine and are also capable of providing the requisite pumping capacity for the circulation of heat transfer medium.

Single-fluid nozzles, particularly hollow-cone nozzles, which permit fine atomisation and a narrow droplet spectrum (with respect to the average droplet diameter) at a relatively low nozzle admission pressure are preferably used as injection nozzles.

Alternatively, the process of laminar jet disintegration may be utilised for droplet production, in which the heat transfer fluid is pumped through capillary nozzles. Capillary nozzles are understood as meaning foils or plates having holes with a diameter which is usually <500 μm. In this context, the diameter of the holes should preferably be of the order of 50 μm.

In one preferred embodiment, the drops are separated from the working gas by means of gravity-assisted centrifugal force separation. Cyclones are particularly suitable for this purpose. A further possible means of droplet separation is to pass spray consisting of working gas and atomised heat transfer fluid through a vessel filled with heat transfer fluid, so that the drops remain in the liquid. In addition, the smallest droplets of heat transfer fluid can be removed from the working gas by means of separator screens.

The Stirling engine or heat engine according to the invention makes it possible to produce cooling or heat by means of working materials which are environmentally harmless. Neither the aforementioned suitable working gases nor the heat transfer media which are preferably used, e.g. silicone oil, have an effect which damages the ozone layer of the atmosphere or which contributes to the "greenhouse effect".

Compared with most of the Stirling refrigerating machines or Stirling heat pumps produced hitherto, the cooling or heat volume output is significantly increased by the elimination of the dead space in the heat exchangers which have become superfluous. The machines can thus be of more compact, lighter and less expensive construction at a comparable output. The heat exchangers of the known Stirling engines, which are expensive to manufacture, are dispensed with. Moreover, standard devices can be employed for the heat exchangers used in the heat transfer medium circuits.

The clear spatial separation of the heat absorption and heat release of the machine makes it easier to design the installation in which the machine is to be used. It is possible to control the output by switching the machine on and off, since no appreciable conduction of heat occurs from the place of heat absorption to the place of heat release.

The formation of a heat exchanger circuit within the Stirling engine according to the invention permits a spatial separation of the production of cooling and heat and the utilisation thereof.

The Stifling refrigerating machine and the Stirling heat pump with the injection of heat transfer medium according to the invention may be driven electrically, or by being mechanically coupled to a motor. Stainless chromium-nickel steels are particularly suitable as the material for the housing and pistons of the Stirling engine, since they combine high strength with what is a low thermal conductivity for metals. Chromium-nickel steels are also a suitable material for the injection nozzles for the heat transfer fluid. Various sizes and designs of the hollow-cone nozzles which are most preferably used have been described, for example for the cooling of gases or for the deposition of foam. Nickel foils are preferably used for the manufacture of capillary nozzles.

The regenerator of the Stirling engine may consist of wire gauze, wire cloth or sintered material in particular.

Suitable pumps for pumping the heat transfer fluid may include both commercially available metering or pressure pumps or the pumping heads thereof, and also special fabrications which are especially tailored to the demands imposed by the refrigerating machine.

The injection of heat transfer fluid as described according to the invention is primarily worthwhile in Stifling refrigerating machines on account of the considerable importance of dead space. Good heat transfer between a medium which is to be heated or cooled and the working gas is important for the figure of merit of a Stirling engine. However, good heat exchangers in known Stirling engines have a large intrinsic volume, even when they are of the proper form, and thus increase the dead space of the machine. This increased dead space in turn reduces not only the output but also the figure of merit of the Stirling engine. Moreover, heat exchangers cannot be disposed in the expansion space or in the compression space of the machine, but are situated on both sides of the regenerator between the working spaces. Heat transfer therefore only occurs after compression, which is associated with the heating of the gas, or after expansion, which is accompanied by cooling of the working gas. It follows from this that the changes of state in the working spaces of prior art Stirling engines are more adiabatic than isothermal. On account of this, the interval between the upper and lower process temperature decreases in the Stirling heat pump or Stirling refrigerating machine, for example, and the figure of merit of these machines decreases. Due to the elimination of the heat exchangers and the injection of the heat transfer fluid into the working spaces of the Stirling engine according to the invention, the problems of known Stirling engines described above are overcome.

In the Stirling engine according to the invention, heat can still be introduced directly into or removed directly from the working spaces during the expansion or compression of the working gas, so that approximately isothermal changes of state can be achieved. Due to the low compressibility of the heat transfer liquid, the space which has to be provided in the machine for the volume of liquid does not signify any increase in dead space. It thus becomes clear that the heat transfer from the working gas to the atomised heat transfer fluid or from the atomised heat transfer fluid to the working gas is quite particularly advantageous heat for the special requirements in a Stirling engine.

A heat transfer fluid is preferably used which remains liquid over a wide temperature range, has physical characteristics which scarcely alter, and has a very low vapour pressure. By this means it becomes possible to use the same liquid in the hot and cold working spaces without the working gas becoming contaminated by the vapour of the heat transfer fluid and without the output being reduced due to evaporation or condensation processes.

The injection of liquids into internal combustion engines is a widely used and established technique. There, however, the volumetric flows to be injected are relatively low, the injection times are very short and the nozzle admission pressures are high. In diesel engines, for example, so-called Borda nozzles are used for injection; these require a high nozzle admission pressure to effect fine atomisation of the liquid fuel.

In a Stirling engine with injection of heat transfer medium according to the invention, the volumes of liquid to be injected are considerably larger, and the nozzle admission pressure which is acceptable from an energetic point of view is comparatively low. Other nozzles which are suitable for low nozzle admission pressures should therefore preferably be used, for example hollow-cone pressure nozzles or capillary nozzles.

In principle, the Stirling refrigerating machine or Stirling heat pump according to the invention can be used in all areas of refrigeration, air-conditioning or heat pump technology. These comprise the following areas of use, for example:

- heat pumps in process technology, medical technology and drying technology (temperature of heat supply: 80° C. to 120° C.)
- heat pumps for space heating, for heat recovery from exhaust air and for providing hot water (temperature of heat supply: 20° C. to 70° C.)
- air conditioning technology (temperature from 0° C. to 20° C.)
- food preservation, ice cream manufacture, ice production, artificial ice rinks, freezer fundamentals, shaft construction (cooling produced at a temperature of −50° C. to 0° C.)
- mechanical engineering, metallurgy, dry ice production, joining technology, freeze-drying, storage of preserved blood, gas treatment (<−50° C.).

Figure 2:
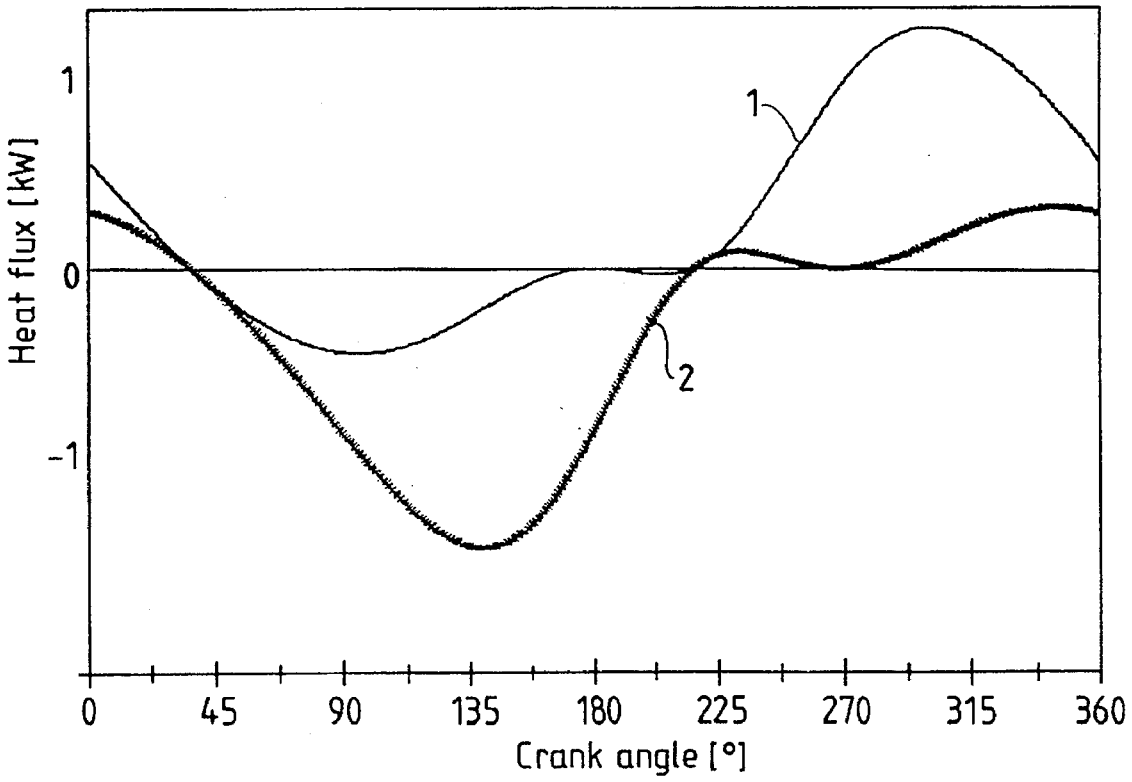
Figure 3:
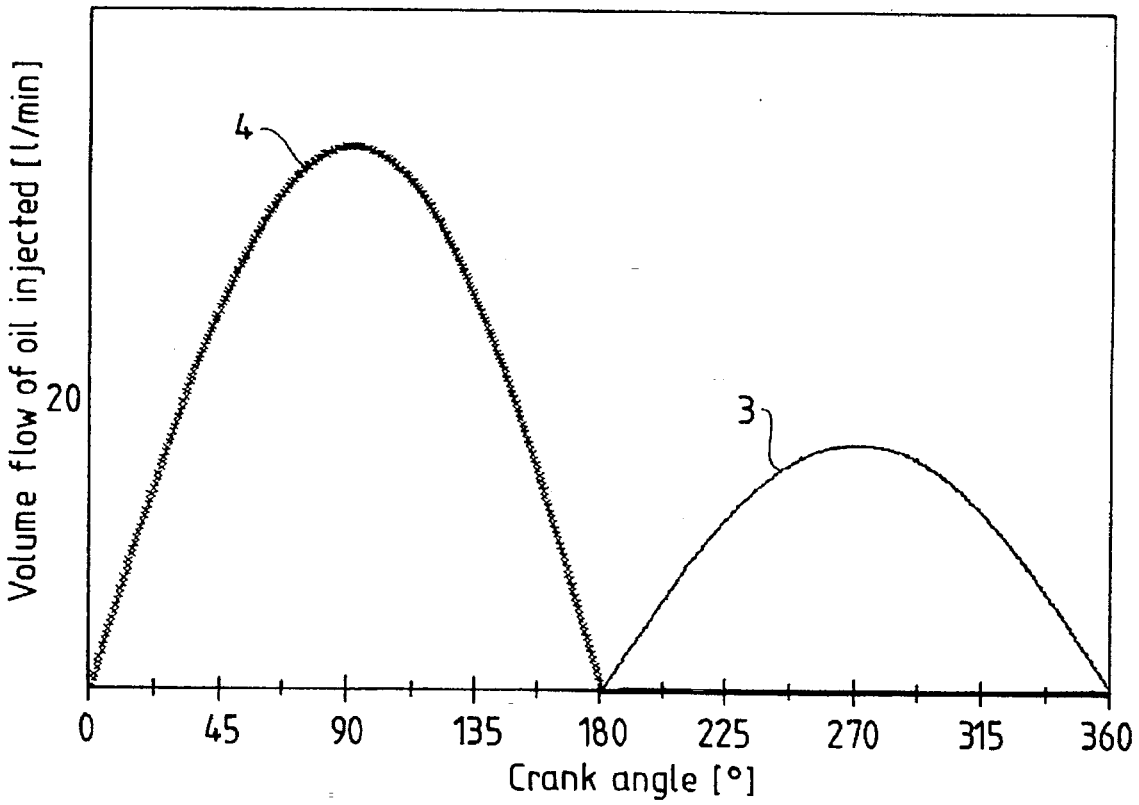
Figure 4:
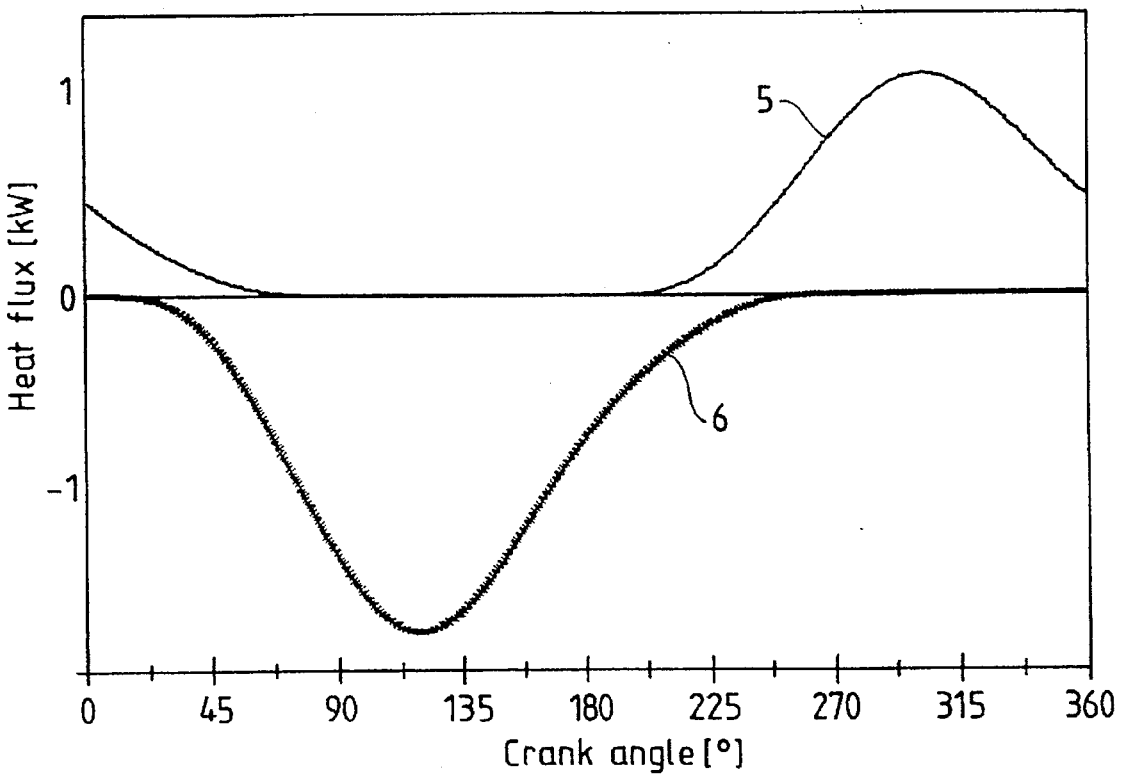

The invention is described in more detail below with reference to the Figures. The illustrations in the Figures are as follows:

FIG. 1 is a diagrammatic view of a Stirling engine according to the invention with injection of heat transfer medium;

FIG. 2 is a calculated graph of the heat fluxes which are supplied or dissipated in the expansion and compression space, respectively, in an isothermally operating Stirling engine, as a function of crank angle FIG. 3 is a calculated graph of the volume flow of oil (heat transfer fluid) in a Stirling engine according to the invention, as a function of crank angle; and FIG. 4 is a calculated graph of the heat fluxes between the working gas and the heat transfer fluid as a function of crank angle.

The heat transfer from a heat transfer medium to the working gas, which is considerably improved compared with Stirling engines produced hitherto, permits a closer approximation to the ideally isothermal changes of state in the working spaces of the Stirling engine. FIG. 2 shows the heat fluxes to be supplied 1 or dissipated 2 during the isothermal changes of state in the expansion space 11 and in the compression space 12 in a Stirling engine designed according to the Schmidt cycle, as a function of crank angle. FIG. 3 illustrates the volume of liquid (volume flow of oil 3) injected per unit time into the expansion space 11 and the volume of liquid (volume flow of oil 4) injected per unit time into the compression space 12, as a function of the crank angle of the Stirling engine. FIG. 4 shows the heat flux 5 transferred at constant temperature from the heat transfer medium to the working gas in the expansion space 11, and the heat flux 6 transferred, at a constant temperature of the working gas, from the working gas to the heat transfer medium in the compression space 12. Due to the supply of heat during expansion and the dissipation of heat during compression, the figure of merit of the machine increases and its energy requirement decreases. The reduction of the dead space also leads to an increase in the figure of merit.

EXAMPLE

An example of an embodiment of a Stirling refrigerating machine with injection of heat transfer medium according to the invention is described with reference to the schematic illustration of FIG. 1.

The machine consists of two cylinders 13 and 14, in which the two working pistons 7 and 8 are situated which are driven via the piston rods 9 and 10 and a crank mechanism, which is not illustrated. The working gas is expanded in working space 11 and compressed in working space 12. From the expansion space 11, the gas flows via the overflow line 15 and the regenerator 17, in which it is heated to the temperature of the compression space 12, and via the overflow line 16 into the compression space 12. When the gas flows from the compression space 12 into the expansion space 11, it is isochorically cooled in the regenerator 17 to the expansion temperature. To a good approximation, the changes of state in the working spaces take place isothermally. In this respect, the requisite amounts of heat are supplied or removed via the injected heat transfer fluid. Injection into the expansion space is effected via the injection nozzles 18 during the expansion stroke. One or more hollow-cone nozzles, which permit fine atomisation of the heat transfer fluid at a low nozzle admission pressure, are used as the injection nozzles. In the compression space the heat transfer fluid is atomised during the compression via the injection nozzles 19. On account of its large surface to volume ratio, the spray of liquid exchanges large amounts of heat with the working gas of the Stirling refrigerating machine within a short period of time. The heat transfer fluid is separated from the overflow line 15 between the expansion space and the regenerator via a gravity-assisted centrifugal separator 28 and a fine separator screen 30, and thereafter enters the collector 26. Separation from the overflow line 16 between the compression space and the regenerator is effected analogously by the centrifugal separator 29 and the fine separator screen 31, which protects the regenerator from being impinged upon by the heat transfer fluid.

From the collector 26, the cold heat transfer fluid coming from the expansion space flows through a heat exchanger 24 in which it absorbs heat from the surroundings to be cooled or from the medium to be cooled. It then flows via a pipeline to pump 22, which produces the requisite nozzle admission pressure for atomisation by the hollowcone nozzles 18. A single-cylinder reciprocating piston pump which is operated at the same rotational speed as the Stirling engine is used as the pump.

The heated heat transfer fluid coming from the compression space flows via the collector 27 through the cooling device 25, where it dissipates heat to the surroundings or to a cooling medium. The pump 23 provides the requisite nozzle admission pressure for renewed injection via the nozzles 19 into the compression space 12.

We claim:

1. A Stirling engine consisting of at least one working space (12), a cold space (11), a diaphragm or a piston (8) with an attached transmission (10), optionally a regenerator (17) between the working space (12) and the cold space (11), and optionally overflow lines (15; 16) which connect the working space (12), the cold space (11) and optionally the regenerator (17) to each other, wherein silicone oil heat transfer fluid is injected through a capillary nozzle or a hollow-cone nozzle into at least one of the spaces (11; 12) for heat exchange between the respective working gas of the spaces (11; 12) and a heat transfer fluid (32), said heat transfer fluid being atomized on injection, and wherein at least one separator (28; 29) for the heat transfer fluid (32) is provided on at least one of the spaces (11) or (12) or is connected into the overflow line (15; 16) which is optionally present, and wherein the heat transfer fluid (32) separated from the working gas is fed in circulation from the separator (28; 29) to the injection of heat transfer fluid (18; 19) again via a heat exchanger (24; 25) and a pump (22; 23).

2. A Stirling engine according to claim 1, characterised in that the requisite nozzle admission pressure for the atomisation of the heat transfer fluid is produced by pumps (22; 23) which deliver discontinuously.

3. A Stirling engine according to claim 1, characterised in that the pumps (22; 23) are driven via the same shaft as the pistons or diaphragms (7; 8) and optionally, run at the same rotational speed as the latter.

4. A Stirling engine according to claim 1, wherein the separator (28; 29) is augmented by a flow reversal, a separator screen, or both a flow reversal and a separator screen (30; 31).

5. A Stirling engine according to claim 1, characterised in that pre-cooling or pre-heating of the heat transfer fluid (32) is effected by heat exchange with the working gas of the Stirling engine via the cylinder wall (13; 14) of the engine.

6. A Stirling engine according to claim 1, for use as a heat pump, a cooling or freezing device for medical technology, or for heating, refrigeration, drying or air-conditioning technology.

* * * * *